United States Patent [19]

Young

[11] Patent Number: 4,858,799

[45] Date of Patent: Aug. 22, 1989

[54] THREE WAY LOCKING SYSTEM FOR A HAND GUN IN A HOLSTER

[76] Inventor: Duane E. Young, 3224 E. Greenway La., Phoenix, Ariz. 85032

[21] Appl. No.: 264,068

[22] Filed: Oct. 28, 1988

[51] Int. Cl.[4] ..... F41C 33/04

[52] U.S. Cl. ..... 224/243; 224/912; 224/238

[58] Field of Search ..... 224/242–246, 224/192, 193, 198, 238, 224–226, 235, 272, 911, 912

[56] References Cited

U.S. PATENT DOCUMENTS

| | | | |
|---|---|---|---|
| 1,046,912 | 12/1912 | Wanee | 224/243 |
| 1,635,984 | 7/1927 | Corriston | 224/244 |
| 2,347,006 | 4/1944 | Tibbetts | 224/193 |
| 2,551,913 | 5/1951 | Toby | 224/244 |
| 2,601,586 | 6/1952 | Brice | 224/243 |
| 3,252,639 | 5/1966 | Sloan | 224/243 |
| 3,268,130 | 8/1966 | Simpson | 224/198 |
| 3,550,822 | 12/1970 | Lloyd | 224/193 |
| 3,669,325 | 6/1972 | Furman | 224/243 |
| 3,828,990 | 8/1974 | Baldocchi | 224/193 |
| 3,866,811 | 2/1975 | Hamby | 224/244 |
| 3,902,639 | 9/1975 | Rogers | 224/193 |
| 3,910,469 | 10/1975 | Baldocchi | 224/198 |
| 3,923,214 | 7/1974 | Kippen | 224/243 |
| 4,030,221 | 6/1977 | Doobenen et al. | 42/70.07 |
| 4,205,768 | 6/1980 | Hill et al. | 224/193 |
| 4,225,067 | 9/1980 | Bianchi et al. | 224/243 |
| 4,256,243 | 3/1981 | Bianchi et al. | 224/244 |
| 4,342,410 | 3/1981 | Sloan | 224/243 |
| 4,750,655 | 6/1988 | Barry | 224/243 |

*Primary Examiner*—Henry J. Recla
*Assistant Examiner*—J. Casimer Jacyna
*Attorney, Agent, or Firm*—M. David Shapiro

[57] ABSTRACT

A locking mechanism for attachment to a hand gun holster, the locking mechanism having a control of a locked position which prevents removal of the hand gun from its holster and a continuum of unlocked positions with progressively more force required to extract the hand gun out of its holster as the force is increased by the operator. A single rotary control allows for setting the mechanism to the fully locked position or to any of the continuum of restraining positions.

7 Claims, 2 Drawing Sheets

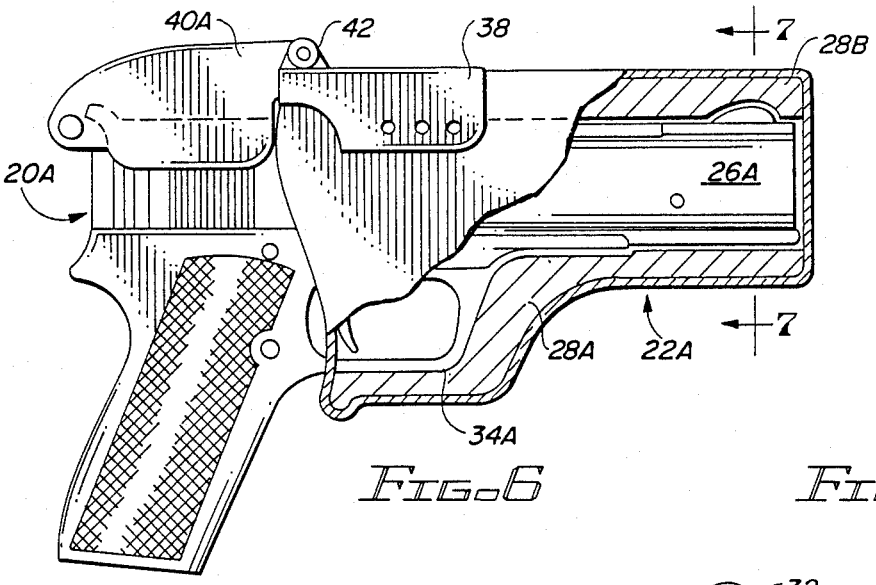
FIG. 6
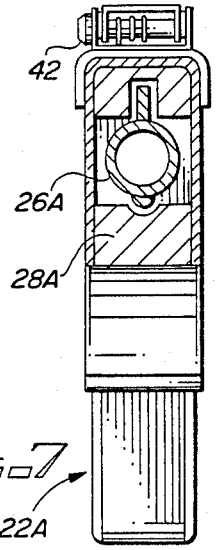
FIG. 7
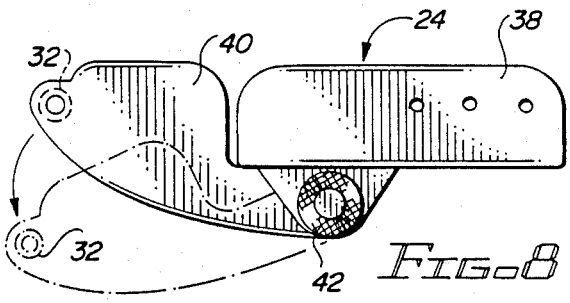
FIG. 8
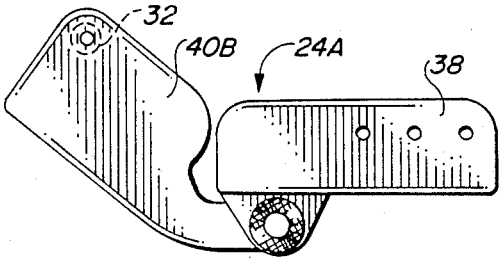
FIG. 9
FIG. 4A
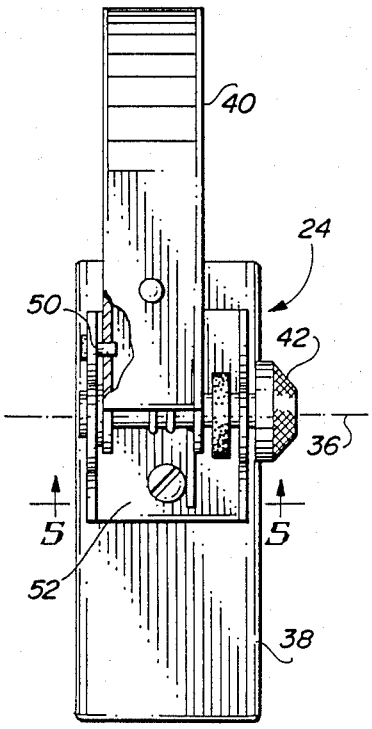
FIG. 4B
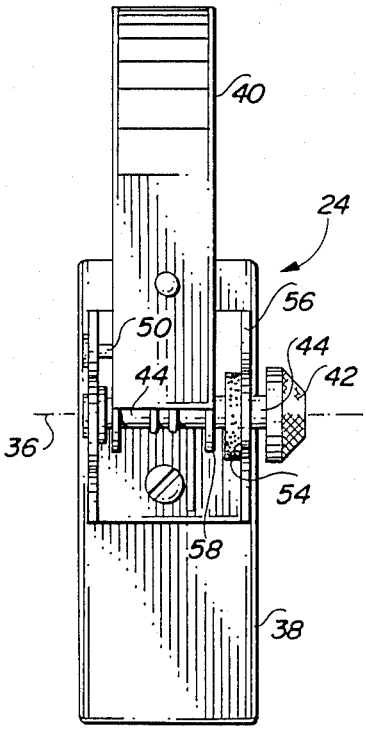
FIG. 4C
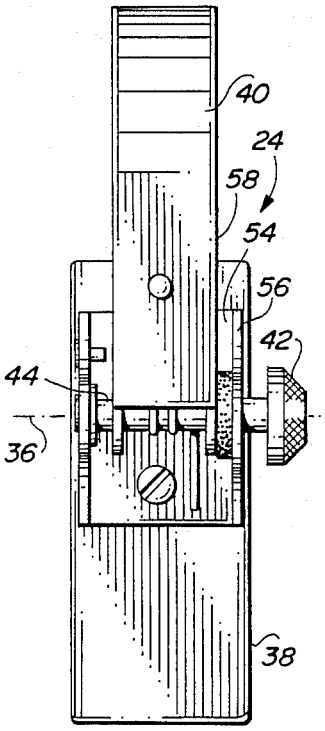

THREE WAY LOCKING SYSTEM FOR A HAND GUN IN A HOLSTER

FIELD OF THE INVENTION

The invention relates to safety apparatus for retaining and protecting a hand gun in a holster.

BACKGROUND OF THE INVENTION

In the interest of safety and security a number of techniques have been developed to assure that a hand gun is retained in a holster until such time as the user wishes to free it for use. It is the object of such apparatus to prevent accidental dislodging of a hand gun from its holster and, sometimes, to prevent unauthorized persons from taking the gun from its owner. It is especially important in police work that unauthorized persons do not have ready access to a policeman's gun.

A simple strap, usually fabricated of leather or other suitable material, has been used to pass behind some part of a gun, usually, but not always, some part of the hand grip, to hold the gun in place in its holster. Generally, some sort of snap fastener is used to fasten the strap in place on one end and the other end is sewn or otherwise permanently fastened to the body of the holster. Such straps are easily opened and may be inadvertently opened by a careless brush of the hand, by some object carrier in the hand of the operator, or by passing too close to another person or object, any of which may disengage the snap fastener end of the strap and cause it to come open. Unfriendly persons are not readily deterred from retrieving a gun fastened into its holster in such a fashion.

More sophisticated apparatus has been used to retain a hand gun in its holster. U.S. Pat. No. 1,046,912, issued to G. M. Wanee, describes a mechanical substitute for a holster which incorporates a lock for the hand gun therein. It includes means for capturing the gun against a metal body plate and provides a mechanism for locking the gun to and for releasing the gun from the plate.

Lloyd's U.S. Pat. No. 3,550,822, teaches a pivoting bar which may be rotated into a position across the open end of a holster or folded back against an upper apron of the holster. In the first case, a hand gun is retained in the holster by the extending retaining bar. In the second case, the gun may be withdrawn from the holster, but only by first simultaneously pressing two different trigger surfaces which releases a spring latch unlocking the retaining bar and swings it out of the way of the gun. The gun may then be withdrawn from its special holster which has an open upper section to permit withdrawal of the weapon from the holster in a forward direction. Hamby's U.S. Pat. No. 3,866,811, teaches a simple latch arrangement which may be used to lock the trigger guard loop of a hand gun to its holster. It employs a safety latch to prevent accidental or unauthorized withdrawal.

Rogers' U.S. Pat. No. 3,902,639, teaches a molded plastic holster shell having a slit front opening with the open edges of the slit being urged into a closed position by means of the resiliency of the plastic material used. The closure force is adjustable by means of an adjuster screw which may be set at a predetermined position to control the closure force and thus, the withdrawal force. A pliable flap of leather or plastic is provided and located to prevent accidental actuation of the hammer mechanism of the hand gun. A similar retaining force adjusting system is shown in Kippen's U.S. Pat. No. 3,923,214.

Baldicchi's U.S. Pat. No. 3,910,469, also teaches holster apparatus which provides for locking a hand gun into the holster with a safety latch used to disengage the gun.

Doobenen et al., U.S. Pat. No. 4,030,221, teaches a trigger guard which also acts to restrict the trigger action while engaged. It has an adjustable spring tension which requires too much force for a child to release, but allows a stronger adult to do so.

Hill et al., U.S. Pat. No. 4,205,768, teaches a "U" shaped "boot" or holster which is closed at a rear portion thereof by a "velcro" (Registered Trademark) adjustable strap. That strap provides an adjustable retention force for a "combat" type weapon, such as a 45 caliber pistol.

Sloan's U.S. Pat. No. 4,342,410, teaches a gun release mechanism which is integral with a belt which supports an essentially conventional holster. The release mechanism acts to positively lock the hand gun into the holster until the release is actuated by the operators non-gun hand from the other side of his body.

While some of the known prior art inventions teach adjustable means for retaining a hand gun in a holster, these means are adjustable only by means of hand tools except for that of Hill et al. which employs Velcro material. Other prior art inventions deal with positive locked retention of a hand gun in a holster. None of these methods or apparatus provide for either a firmly locked hand gun or a variable release force in the same mechanism which may be operated without tools.

SUMMARY OF THE INVENTION

These and other problems with prior art inventions are resolved by means of the instant invention in which a single mechanism is employed which allows the operator to determine, first, whether the hand gun should be absolutely locked in its holster unless a conscious effort is made to unlock the gun, and second, whether the hand gun should be restrained in its holster by means of a variable range of retention forces as selected by the operator from time to time and which may be activated and/or adjusted without the use of any ancillary tools.

Therefore, it is an object of the invention to provide apparatus for locking a hand gun in its holster in a positive way to prevent unauthorized persons or inadvertent withdrawal of the gun.

It is another object of the invention to provide apparatus which may be used by the operator to set a predetermined selectable retention force on a hand gun in a holster without the use of ancillary tools.

It is still another object of the invention to provide apparatus for either locking a hand gun in its holster in a positive manner or to provide for an operator selectable retention force which is selectable without the use of ancillary tools.

These and other objects of the invention will be more readily understood upon study of the Detailed Description of the Preferred Embodiment of the Invention, infra, taken together with the drawings, in which:

FIG. 4A is a bottom view of the apparatus of the invention, according to FIG. 2, in the fully locked position;

FIG. 4B is a bottom view of the apparatus of the invention, according to FIG. 2, in an unlocked position with minimum retention force applied;

FIG. 4C is a bottom view of the apparatus of the invention, according to FIG. 2, in an unlocked position with maximum retention force applied;

FIG. 6 is a partial cut-away side view of the locking mechanism of the invention mounted on a holster for an automatic pistol;

FIG. 7 is a cross-sectional view of the assembly of FIG. 6 taken from 7—7;

FIG. 8 is a side view of the apparatus of the invention according to FIG. 2 showing the locked or retention position and the open position (in phantom); and FIG. 9 is an opposite side view of the apparatus of the invention according to a modification of the apparatus of FIG. 6, further modified for a left handed operator.

Figure 1:
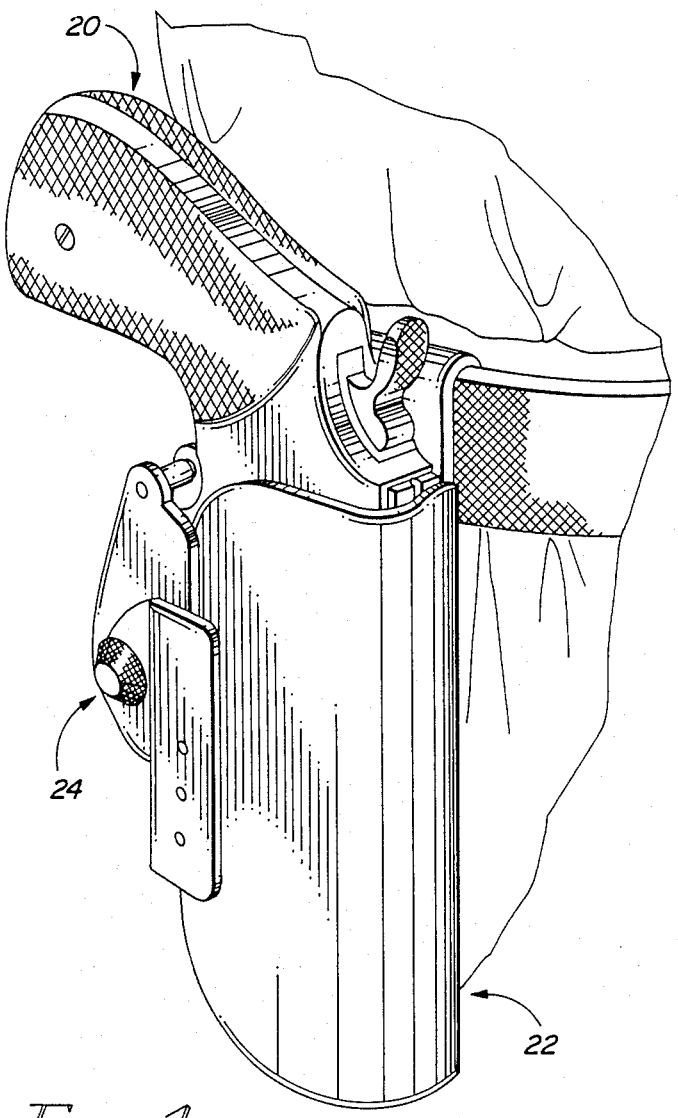
FIG. 1 is a perspective view of the locking means of the invention installed on a holster for a revolver showing the locking mechanism engaged behind the trigger guard of the hand gun.

DETAILED DESCRIPTION OF THE PREFERRED EMBODIMENT OF THE INVENTION (It should be noted that wherever in this specification like reference numerals are used they refer to like features of the invention. Wherever an alphabetic suffix is appended to such reference numerals, they indicate a variation of or a different version of the same reference numeral which does not carry such suffix.)

The device of the invention is shown in FIG. 1 as shown mounted on a holster for a revolver type hand weapon. Revolver 20 is shown inserted in holster 22 (sometimes referred to as a "boot"). The locking apparatus of the invention 24 is shown as a part of the holster 22 assembly.

Figure 2:
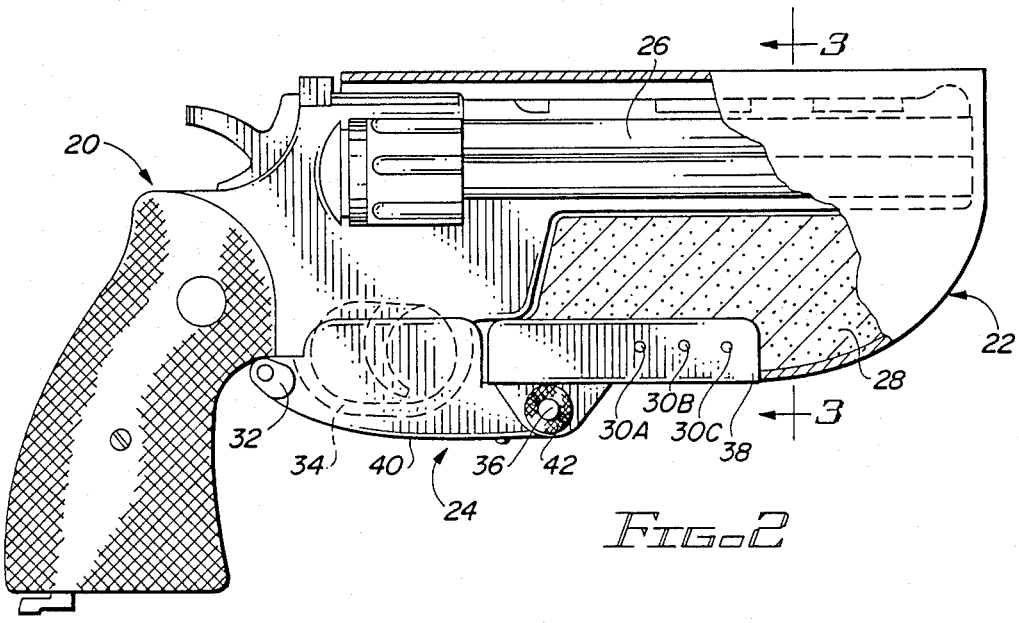
FIG. 2 is a partial cut-away side view of the invention of FIG. 1.

FIG. 2 is a partially cut-away side view of the assembly of FIG. 1. Hand gun (revolver) 20 fits in holster 22 in such a way as to prevent it from motion other than that motion which is axial to barrel 26 of hand gun 20. Rigid filler material 28 is employed to prevent other than axial motion of barrel 26 within holster 22. Further, barrel 26 is a snug fit against the corresponding upper inner surface of holster 22 to aid in preventing any but axial motion of barrel 26.

It will be seen that the locking apparatus 24 of the invention is attached to holster 22 by means of fasteners 30A, 30B and 30C which may be rivets or the like. Cross blocking rod 32 of apparatus 24 bears against an after side of trigger guard 34 to prevent withdrawal of hand gun 20 from holster 22. Pivot axis 36 acts as a hinge point between fixed portion 38 of locking apparatus 24 and moveable portion 40 of locking apparatus 24. The configuration of locking assembly 40 will be better understood upon study of the following.

Figure 5:
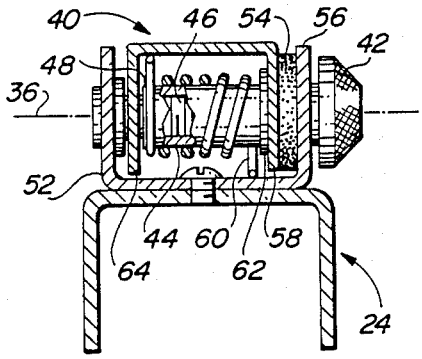
FIG. 5 is a cross-sectional view of the locking mechanism of the invention taken from 5—5 of FIG. 4A.
Figure 3:
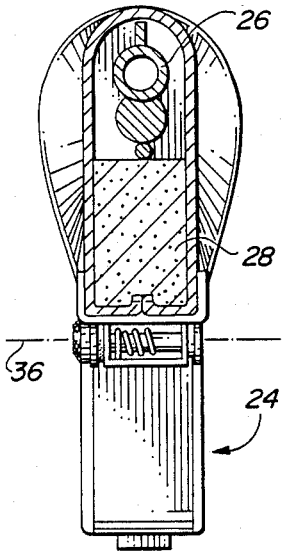
FIG. 3 is a cross-section of the assembly of FIG. 2 taken at 3—3.

FIGS. 4A, 4B and 4C are bottom views illustrative of various adjustments of locking apparatus 24. In FIG. 4A, adjustor knob 42 is turned fully clockwise, as it appears at the knob 42 end. (It will be assumed that a right hand thread set is utilized in threaded tube 44 and threaded rod 46 for the balance of this discussion.) FIG. 5 may be employed to aid further explanation of the import of this adjustment. Knurled knob 42 is permanently fastened to, and becomes a part of, internally threaded tube 44. Male threaded rod 46 is firmly and permanently attached to and becomes a part of moveable portion 40 of apparatus 24. When knob 42 is rotated fully clockwise, tube 44 is threaded onto rod 46 and the left end 48 of threaded tube 44 engages leg 64 of bracket 52, a part of moveable portion 40 of apparatus 24, and causes it to move to the left. (A washer, not shown, may be interposed between the left end of tube 44 and leg 64 of moveable portion 40, bracket 52, to reduce friction.) In FIG. 4A it may be seen that this clockwise rotation of knob 42 causes pin 50, which is attached to and is a part of bracket 52, to engage a hole (not numbered) in a moveable portion 40 of apparatus 24. This action firmly locks moveable portion 40 so that portion 40 cannot pivot about pivot axis 36 with respect to fixed portion 38 of assembly 24 of the invention.

In the position just described, hand gun 20 may not be withdrawn from holster 22. This is because blocking rod 32, a part of moveable portion 40 of mechanism 24, is located behind trigger guard 34 and prevents such movement.

FIG. 4B illustrates another relative position of moveable portion 40 with respect to fixed portion 38 of locking mechanism 24 of the invention. Knob 42 has been rotated counterclockwise, resulting in tube 44 being moved to the right far enough to disengage pin 50, but not all the way to the right limit of the mechanism. This action occurs because of "C" washer 62 (or the like) which engages a slot in tube 44 adjacent leg 58 of moveable portion 40 and acts to urge moveable portion 40 to the right when knob 42 is rotated in a counterclockwise direction. Friction washer 54 is not captured between upright wall 56 of bracket 52 and leg 58 of moveable portion 40, but rather, it floats between them. Torsion spring 60, wrapped about tube 44 exerts a closing force on moveable portion 40 to keep it in the closed or retention position as shown in FIGS. 1 and 2. However, it should be noted that this is the minimum retention force available using this system. This minimum retention force is solely a function of the design of spring 60.

FIG. 4C illustrates the maximum retention force position (disregarding the full lock position shown in FIG. 4A). Knob 42 has been rotated fully counterclockwise which pushes moveable portion 40 far to the right, squeezing friction washer 54 between leg 56 of fixed portion 38 bracket 52 and leg 58 of moveable portion 40. The further counterclockwise knob 42 is rotated, the tighter friction washer 54 is squeezed and the more retention force is applied to moveable portion 40 of the apparatus.

Thus, it may be seen that the apparatus of the invention provides a fully locked position, a positional range providing for minimum retention force, and a continuum range of retention forces from minimum to maximum with only a single operating control knob 42. Knob 42 is located on the right side (for a right handed person) of holster 22 for convenience of operation by the person's right hand.

FIG. 6 illustrates an alternate embodiment of the invention as it would be applied to a holster 22A for automatic pistol 20A. Because, typically, such pistols have a trigger guard 34A which has no rear edge which may be engaged by retention or blocking rod 32, the apparatus may be slightly modified to mount on the top side (rather than the under side) of the holster, as shown in FIG. 6. Similar to the configuration of FIG. 2, filler material 28A is used within holster 22A to assure that pistol 20A is held in a position preventing movement in any direction except along the longitudinal axis of barrel 26A. Pistol 20A may be held away from the top of holster 22A by use of filler material 28B, as shown.

Apparatus 24 may be modified as shown in FIG. 9 to allow the apparatus to fit other configurations of pistols and holsters, depending on the relative positions of pistol 20A and holster 22A. In any case, the operation and configuration of the locking mechanism is the same as has been before described. It is believed that the design disclosed herein is flexible enough to provide the three way locking system described herein for nearly any configuration of hand gun and holster combination.

While the invention has been particularly shown and described herein with reference to a preferred embodiment thereof, it will be understood by those skilled in the art that various other modifications and changes may be made to the present invention from the principles of the invention as herein described without departing from the spirit and scope as encompassed in the accompanying claims. Therefore, it is intended in the appended claims to cover all such equivalent variations which may come within the scope of the invention as described.

What is claimed is:

1. Apparatus for releasably retaining a hand gun in a holster, the hand gun having at least a barrel, said apparatus comprising:

means for aligning the barrel of the hand gun in the holster about a longitudinal axis of the barrel and for essentially restricting movement of the barrel to a direction along said longitudinal axis;

means for releasably retaining the hand gun in the holster, said means for releasably retaining the hand gun in the holster having an engaged position and a disengaged position, said engaged position providing for retention of the hand gun in the holster and said disengaged position providing for release of the hand gun from the holster, said means for releasably retaining the hand gun further comprising:

means for fastening said means for releasably retaining the hand gun to the holster;

means for locking said means for releasably retaining the hand gun in the holster for preventing removal of the hand gun from the holster;

means for adjusting a releasing force required to remove the hand gun from the holster when said means for locking is released, said locking means and said adjusting means being operable from a single control.

2. The apparatus according to claim 1 wherein said means for releasably retaining the hand gun in the holster further comprises:

a fixed assembly, said fixed assembly being fastened to one of an upper and a lower portion of the holster, said one of said upper and said lower portion of said holster being a portion of the holster in an area surrounding the barrel of the hand gun when the hand gun is stowed in the holster;

a moveable assembly; and pivot means for attaching said moveable assembly to said fixed assembly.

3. The apparatus according to claim 2 wherein said pivot means further comprises:

a first thread rotatably attached to said moveable assembly;

a second thread fixed to said fixed assembly, said first and said second thread being of opposite gender and said first and said second threads being threadably interconnected on a common axis of said first and said second threads, said common axis being an axis of said pivot means, said single control being connected to said first thread for rotating said first thread with respect to said second thread thereby moving said moveable assembly with respect to said fixed assembly along an axis of said pivot means.

4. The apparatus according to claim 3 wherein the hand gun has a trigger guard, wherein said moveable assembly further comprises a locking bar, said locking bar being located behind one of the trigger guard and a rearward upper portion of the hand gun when the hand gun is stowed in the holster and when said moveable assembly is in said retaining position.

5. The apparatus according to claim 3 wherein said means for adjusting a releasing force further comprises;

torsion spring means for urging said moveable assembly into a locking position, a torsion force of said torsion spring means being applied between said fixed assembly and said moveable assembly to apply a force to said moveable assembly;

a clutch, said clutch further comprising a friction washer located between adjacent parts of said fixed assembly and said moveable assembly on a longitudinal axis of said pivot means, said releasing force being adjusted by means of a variable compressive force on said friction washer, said variable compressive force being controlled by rotation of said single control of said pivot means.

6. A locking apparatus for a hand gun in a holster comprising in combination:

a fixed portion, said fixed portion being adapted for attachment to said holster;

a moveable portion, said moveable portion comprising a locking bar for retaining the hand gun in the holster, said locking bar being adapted for restricting withdrawal of the hand gun from the holster;

a pivot assembly having a longitudinal axis thereof, said pivot assembly being located between said fixed portion and said moveable portion, said pivot assembly further comprising:

a threaded rod, said threaded rod being attached to said fixed portion to prevent relative rotation between said fixed portion and said threaded rod;

an internally threaded tube, said internally threaded tube being threadably connected to said threaded rod at a first end of said internally threaded tube, said internally threaded tube having a control knob attached to a second end of said internally threaded tube;

a friction washer, said friction washer being disposed between parallel surfaces of said fixed portion and said moveable portion, said longitudinal axis passing perpendicularly through a hole in said friction washer, whereby said control knob may be rotated by an operator in a first direction to increase a compression of said friction washer between said parallel surfaces of said fixed and said moveable assemblies, and whereby said control knob may be rotated by an operator in a second direction to decrease said compression of said friction washer, said moveable assembly being moveable along said longitudinal axis of said pivot assembly, said moveable assembly being rotatably captured to said internally threaded tube of said pivot assembly, said moveable assembly being transported in either of two directions along said longitudinal axis of said pivot assembly when said internally threaded tube is rotated by means of said control knob.

7. The apparatus according to claim 6 further comprising:

a locking detent, said locking detent being attached to said fixed assembly and protruding on an axis perpendicular to and centered in a hole in said moveable assembly when said moveable assembly is in a closed position.

* * * * *